US006761330B1

(12) United States Patent
Bittle et al.

(10) Patent No.: US 6,761,330 B1
(45) Date of Patent: Jul. 13, 2004

(54) ROCKET ACCURACY IMPROVEMENT DEVICE

(75) Inventors: David A. Bittle, Decatur, AL (US); Donald E. Davis, Huntsville, AL (US); Robert C. Glover, Huntsville, AL (US); Roswell W. Nourse, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/457,695

(22) Filed: May 19, 2003

(51) Int. Cl.[7] ..... F42B 10/00
(52) U.S. Cl. ..... 244/3.23
(58) Field of Search ..... 244/129.1, 131, 244/125, 118.2, 121, 3.23, 3.1, 3.2

(56) References Cited

U.S. PATENT DOCUMENTS 2,979,285 A * 4/1961 Planitzer ..... 244/3.21
3,286,630 A * 11/1966 Salmirs et al. ..... 102/377
4,690,350 A * 9/1987 Grosso et al. ..... 244/3.1
5,139,216 A * 8/1992 Larkin ..... 244/3.21
5,564,651 A * 10/1996 Wiemer et al. ..... 244/3.21
5,708,232 A * 1/1998 Nedderman, Jr. ..... 114/23
6,364,248 B1 * 4/2002 Spate et al. ..... 244/3.23
6,646,242 B2 * 11/2003 Berry et al. ..... 244/3.1
6,666,144 B1 * 12/2003 Kim et al. ..... 102/374

* cited by examiner

*Primary Examiner*—Charles T. Jordan
*Assistant Examiner*—S A Holzen
(74) *Attorney, Agent, or Firm*—Hay Kyung Chang

(57) ABSTRACT

Rocket Accuracy Improvement Device, when coupled between the warhead and motor of a typical free flight rocket, isolates the warhead from the rocket motor in the axis using a plurality of ball bearings and thereby enables the warhead to spin independently of the motor. The separation of the warhead from the motor allows the angular momentum of the warhead, which has reached its maximum spin rate by the time the motor burns out, to act gyroscopically to maintain the trajectory of the rocket even when the motor reverses its spin, thus achieving a much more predictable flight path for the rocket.

6 Claims, 2 Drawing Sheets

ROCKET ACCURACY IMPROVEMENT DEVICE

DEDICATORY CLAUSE

The invention described herein may be manufactured, used and licensed by or for the Government for governmental purposes without the payment to us of any royalties thereon.

BACKGROUND OF THE INVENTION

Currently a typical free flight rocket, comprised of a warhead and a motor, spins the entire rocket assembly in the same direction and has a relatively high moment of inertia. At motor burn-out, the rocket undergoes an abrupt reversal of spin direction. This reversal, caused by an aerodynamic torque from the fins, creates a perturbation in the rocket trajectory, making the trajectory erratic. A more predictable trajectory and thus greater accuracy in the rocket aim would be achieved if the spin of the warhead could be separated from the spin of the motor at the time of motor burn-out. Such separation would reduce the effective roll inertia of the rocket and enable the warhead, and thus the entire rocket, to maintain the original trajectory.

SUMMARY OF THE INVENTION

Rocket Accuracy Improvement Device 102, when coupled between warhead 103 and motor 101 of a typical free flight rocket 100, isolates the warhead from the rocket motor in the roll axis using a plurality of ball bearings and thereby enables the warhead to spin independently of the motor. This reduces the effective roll inertia of the rocket at the time of spin reversal at motor burn-out. Further, the separation of the warhead from the motor allows the efficient rapid initial spin-up of just the motor during motor boost. This rapid initial spin-up reduces the effects of thrust misalignment and rocket imbalance that are largely responsible for rocket dispersion, thus setting the rocket on a more accurate trajectory at the start.

During the powered stage of the rocket flight, a portion of the motor spin is transferred to the warhead due to the bearing drag torque, with the warhead reaching its maximum spin rate at the time the motor burns out. Therefore, even when the motor reverses its spin, the angular momentum of the warhead tends to act gyroscopically to maintain the trajectory of the rocket, thus achieving a much more predictable flight path for the rocket.

DESCRIPTION OF THE PREFERRED EMBODIMENT

Figure 1:
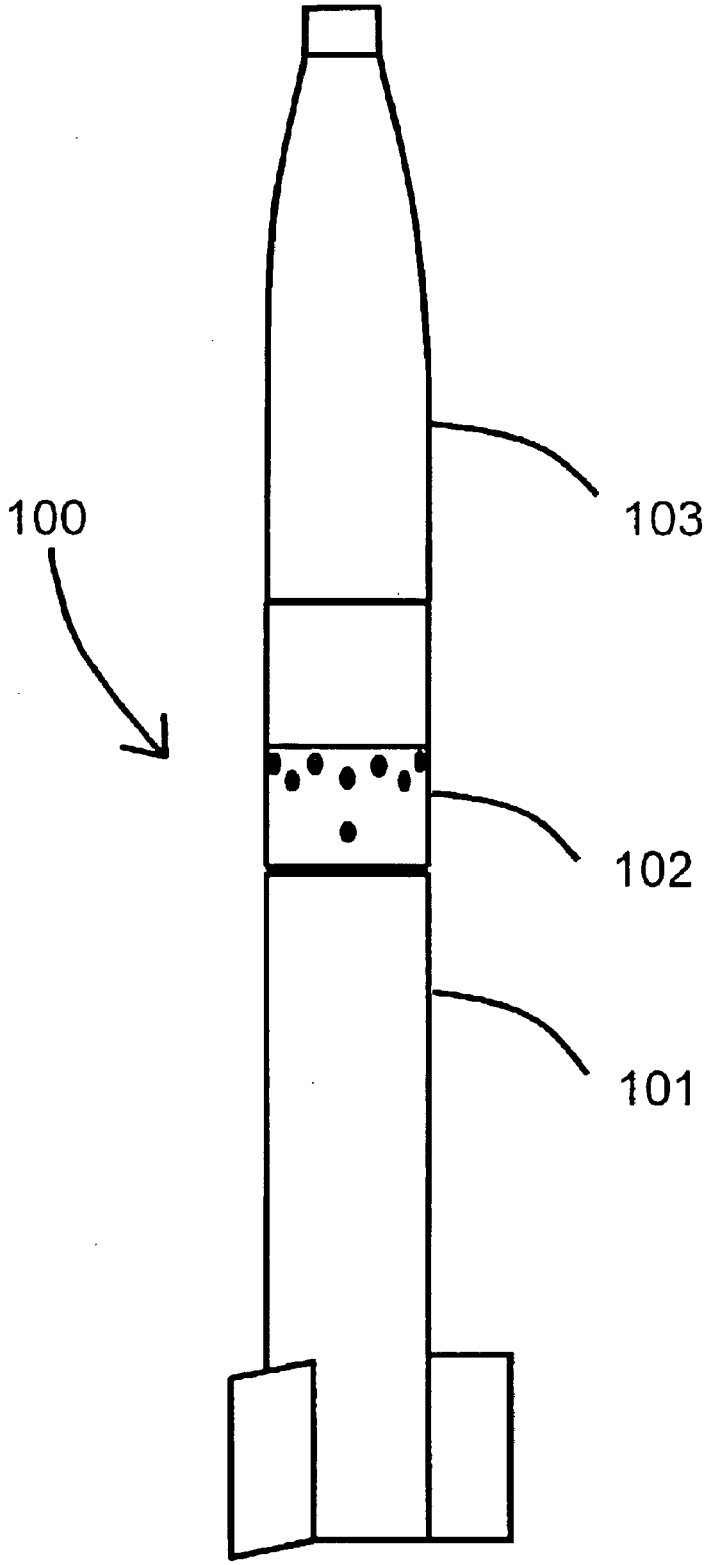
FIG. 1 depicts the position of the Rocket Accuracy Improvement Device in a typical free flight rocket comprising a warhead and a motor.
Figure 2:
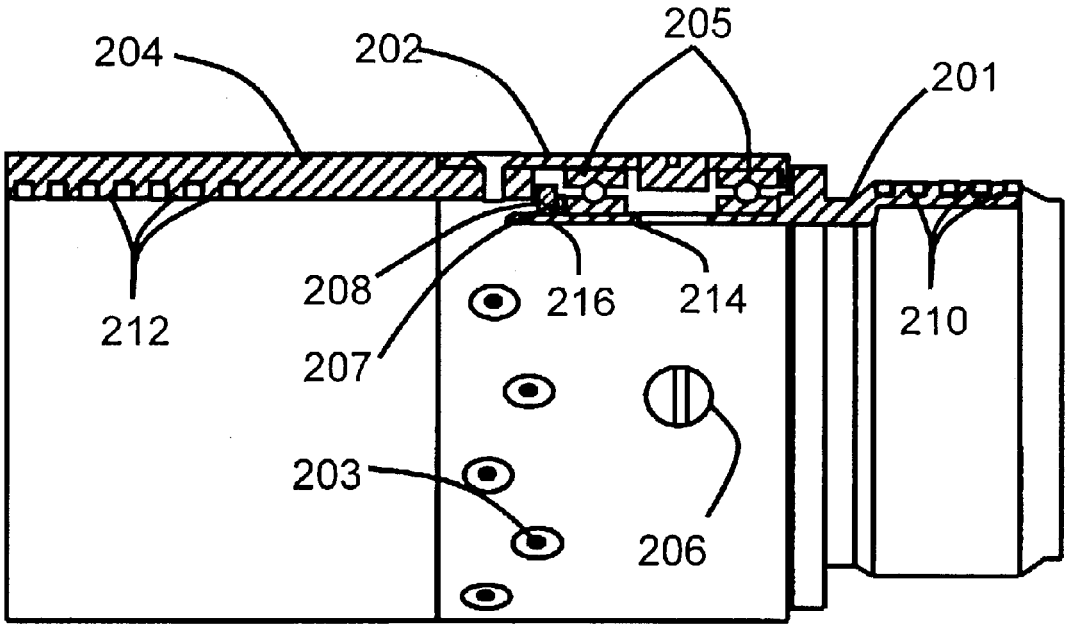
FIG. 2 is a cross-sectional diagram of a preferred embodiment of the Rocket Accuracy Improvement Device.

Referring now to the drawing wherein like numbers represent like parts in each of the figures, FIG. 1 shows where in a typical free flight rocket 100, such as HYDRA 70, the Rocket Accuracy Improvement Device (hereinafter referred to as the "Device") should be placed while FIG. 2 shows the structural details of a preferred embodiment of the Device.

As shown in FIG. 1, the Device is coupled between motor 101 and warhead 103 by screwing motor adapter 201 into the forward section of the motor so that the motor adapter spins with the motor and by screwing warhead adapter 204 into the warhead. The motor adapter has threaded portion 210 and the forward section of the motor has a corresponding threaded segment (not shown). The warhead adapter may be a simple hollow aluminum shell that has internal screw thread 212 matching that on the rear portion of the warhead.

The warhead adapter is adjacent and connected to housing 202 via radial screws 203. The housing, which spins with the warhead, is the outer shell that contains therein ball bearings 205 which fit between the housing and spindle 214 and are mounted to ride on the spindle. The spindle is a feature that extends from motor adapter 201 and, as illustrated in FIG. 2, extends even farther forward past the ball bearings with short threaded end 216 which mates with spacer 207 and locknut 208. The spacer and locknut are used to pre-load ball bearings 205. The pre-loading is accomplished by tightening the locknut against the threaded end of the spindle on which the ball bearings ride to a pre-determined torque value to ensure both the smooth operation of the Device and to tune the spin rate of the warhead during flight. The pre-loaded ball bearings, such as Miniature Precision Bearing S3342MCHH5-LO2 and Torrington B545DD, allow the warhead and the motor of a rocket to spin independently of each other and isolate the warhead from the erratic spin profile of the rocket motor at motor burn-out.

With the warhead and the motor thusly de-coupled, the rocket accelerates in the spin axis much more rapidly when the rocket motor is ignited and the exhaust gases cause the rocket both to accelerate out of the launch tube and to spin. The increased spin rate, in turn, causes any off-axis thrust present in the rocket to integrate towards zero much more quickly and result in a straighter initial flight path for the rocket. This tendency to stabilize the rocket occurs during a critical period in the rocket flight when aerodynamic forces are at a minimum. During the powered stage of the flight, a portion of the motor spin is transferred onto the warhead due to the bearing drag torque, the spin of the warhead reaching its maximum rate at the time of the motor burn-out. The warhead thus imparts its maximum gyroscopic stabilizing effect and continues spinning in its initial direction when the motor has expended its fuel and reverses its spin direction. The reduction of the mass of the motor by the weight of the expended fuel at this point in the rocket flight means greater influence of the now-dominant gyroscopic forces imparted by the spinning warhead to decrease trajectory dispersion significantly.

Although a particular embodiment and form of this invention has been illustrated, it is apparent that various modifications and embodiments of the invention may be made by those skilled in the art without departing from the scope and spirit of the foregoing disclosure. An example is removable plugs 206, along the exterior of housing 202, that allow the insertion of assembly tools to secure the Device tightly onto the rocket during the production of the rocket. Accordingly, the scope of the invention should be limited only by the claims appended hereto.

We claim:

1. In a rocket comprised of a warhead and a motor, a device to improve the accuracy of the rocket, said device being insertable between the warhead and the motor and comprising: a motor adapter for coupling said device to the motor, said motor adapter having a spindle extending therefrom and spinning with the motor, said spindle has having a threaded end; a housing coupled to spin with the warhead; a means to couple said housing with the warhead: a plurality of ball bearings position to ride on said spindle, said ball bearings and said spindle being located inside said housing, said ball bearings enabling the motor and the warhead to spin independently of each other, said independent spin resulting in decreased sensitivity of the rocket to thrust misalignment and dynamic imbalance and improved rocket accuracy.

2. A device as set forth in claim 1, wherein said device further comprises: a spacer and a locknut, said spacer and locknut being positioned inside said housing to interface with said threaded end of said spindle and being tightened to a pre-determined torque value for smooth operation of said device.

3. A device as set forth in claim 2, wherein said means for coupling said housing with the warhead comprises: a warhead adapter shaped to mate with said warhead; and a plurality of radial screws, said screws securing said housing to said warhead adapter.

4. A device as set forth in claim 3, wherein said device still further comprises: a plurality of removable plugs, said plugs being located on the exterior of said housing and allowing the insertion of assembly tools for securing said device and warhead to the motor.

5. In a rocket comprised of a motor having a first threaded portion and a warhead having a second threaded portion, a device to improve the accuracy of the rocket, said device being insertable between the warhead and the motor and comprising: a motor adapter for coupling said device to the motor, said motor adapter having a spindle extending therefrom, said spindle having a threaded end and said motor adapter spinning with the motor; a housing coupled to spin with the warhead; a warhead adapter for coupling said housing with the warhead; at least two ball bearings positioned to ride on said spindle, said ball bearings and said spindle being located inside said housing; said ball bearings enabling the motor and the warhead to spin independently of each other, said independent spin resulting in decreased sensitivity of the rocket to thrust misalignment and dynamic imbalance; a spacer and a locknut, said spacer and locknut being positioned inside said housing to interface with said threaded end of said spindle and being tightened to a pre-determined torque value for smooth operation of said device.

6. A device to improve the accuracy of the rocket as described in claim 5, wherein said motor adapter and warhead adapter have a third threaded portion and a fourth threaded portion to mate with said first and second treaded portions, respectively.

* * * * *